United States Patent [19]

Sherrow

[11] Patent Number: 4,497,512

[45] Date of Patent: Feb. 5, 1985

[54] EMERGENCY RELEASE HANDLE

[75] Inventor: Lionel Sherrow, Huntingdon Valley, Pa.

[73] Assignee: The Budd Company, Troy, Mich.

[21] Appl. No.: 533,388

[22] Filed: Sep. 19, 1983

[51] Int. Cl.[3] ..... E05C 15/02

[52] U.S. Cl. ..... 292/92; 49/141; 74/526; 105/348; 292/307 R; 292/336.3

[58] Field of Search ..... 292/307 R, 92, 21, 336.3; 70/416, 92; 49/141; 105/348, 349; 74/526

[56] References Cited

U.S. PATENT DOCUMENTS

| | | | |
|---|---|---|---|
| 395,412 | 1/1889 | Wilson | 105/348 |
| 1,136,141 | 4/1915 | Kelley | 49/141 X |
| 1,561,029 | 11/1925 | Schmitz et al. | 49/141 X |
| 2,229,273 | 1/1941 | Brockway | 49/141 |
| 3,062,033 | 11/1962 | Schmalfeldt | 292/336.3 X |
| 3,645,572 | 2/1972 | McFarlane | 292/92 X |
| 4,164,095 | 8/1979 | Musacchia | 292/21 X |
| 4,290,368 | 9/1981 | Mazzini | 105/348 X |
| 4,438,966 | 3/1984 | Eckstein et al. | 292/307 R X |

FOREIGN PATENT DOCUMENTS

| | | | |
|---|---|---|---|
| 833995 | 2/1970 | Canada | 49/141 |
| 852947 | 10/1952 | Fed. Rep. of Germany | 49/141 |

*Primary Examiner*—Gary L. Smith
*Assistant Examiner*—Russell W. Illich
*Attorney, Agent, or Firm*—Edward M. Farrell; Herman Foster; T. I. Davenport

[57] ABSTRACT

An emergency release handle is pivotally mounted within an interior wall of a railcar and connected to pull a cable under emergency conditions to actuate a mechanism, such as a mechanism to open a door. The handle is normally maintained inside the wall by a flexible guard plate and retaining screws passing through screw holes which are connected to the wall surface. Manual gripping means is connected to the handle to permit a person to grip it and pull to cause the flexible guard to flex and pass the retaining elements and permit the handle to pivot and pull the cable.

6 Claims, 4 Drawing Figures

EMERGENCY RELEASE HANDLE

BACKGROUND OF THE INVENTION

Emergency door release handles in railway cars are well known. Generally, such a handle is connected to pull a cable to operate a mechanism in a car, such as to result in the doors of the car being opened, for example. Very often, the handle is encased inside the interior wall surface and protected by glass. Under emergency conditions, a person would break the glass to gain access to the handle.

A U.S. Pat. No. 2,229,273 to Brockway discloses another type of emergency door actuator for vehicles.

In the case where the emergency handle is encased inside a wall and covered by a glass sheet, a person normally must first find an object with which to break the glass before the handle can be reached. This is time consuming and inconvenient in an emergency situation. Also, after the handle is actuated to pull the cable, there is no limit to the amount of excess force exerted on the cable. This may cause damage to the cable and associated parts.

OBJECTS OF THE INVENTION

It is an object of this invention to provide an improved emergency handle for actuating a mechanism under emergency conditions.

It is a further object of this invention to provide an improved emergency handle which is readily accessible and which can be actuated quickly.

It is still a further object of this invention to provide an improved emergency handle, the operation of which will not cause damage to any of the parts associated with the handle.

It is still a further object of this invention to provide an improved emergency handle, which is immediately resuable after operation.

BRIEF SUMMARY OF THE INVENTION

In accordance with the present invention, an emergency release handle for pulling a cable in a railcar under emergency conditions is provided. The pulling of the cable actuates a mechanism to cause the doors in the car to open, for example. The handle is pivotally mounted within an interior wall of the rail car. The handle is held inside the wall by a flexible member having a pair of slots therein and retaining screws passing through the slots into the surface of the interior wall. Manual gripping means are connected to the handle to permit a person to pull under emergency conditions. When the gripping means is pulled, the flexible member flexes and snaps past the retaining screws causing the handle to be pivoted to pull the cable, thereby permitting actuation of the mechanism to open the car doors, for example.

Other objects and advantages of the present invention will be apparent and suggest themselves to those skilled in the art, from a reading of the following specification and claims taken in conjunction with the accompanying drawings.

DESCRIPTION OF THE INVENTION

Figure 1:
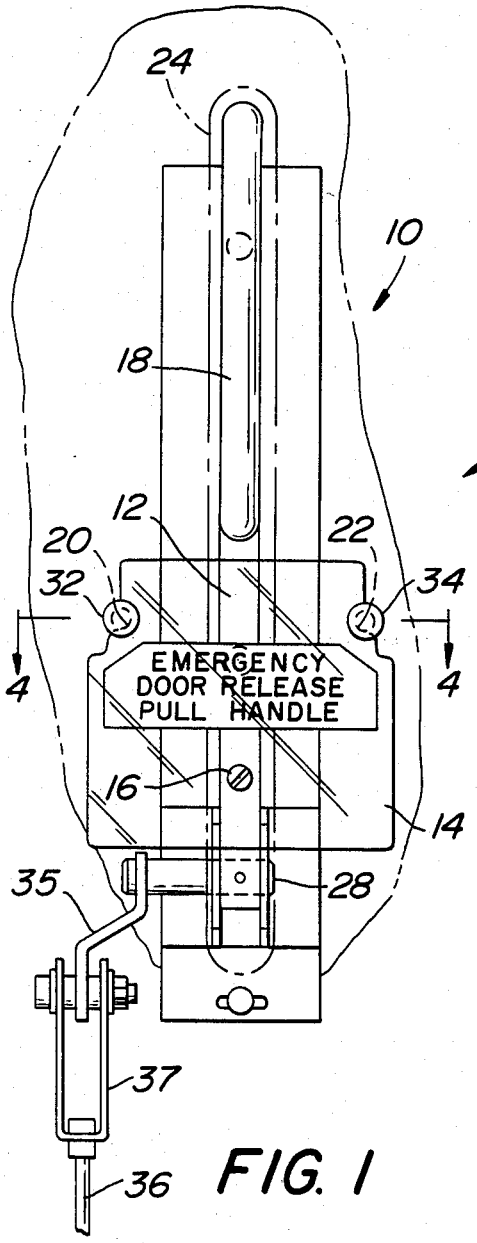
FIG. 1 is a front elevation view illustrating an emergency release handle, in accordance with the present invention.

Referring to the drawings, an emergency actuator mechanism 10 includes a handle 12. A flexible guard plate 14 is secured to the bottom of the handle 12 by suitable means, such as by a screw 16. Manual gripping means 18 is secured to the top portion of the handle 12.

The flexible guard plate 14 may be of rectangular shape and include suitable indicia thereon for instructions to a person in an emergency. The flexible guard plate 14 includes a pair of cut-out sections or slots 20 and 22.

The handle 12 of the mechanism 10 is adapted to be mounted inside of a recess opening 24 on an interior wall 26. The handle 12 is mounted and linked to pivot or rotate with the pin 28 extending through a bottom opening 30 of the handle 12. The pin is connected to move the lever 35 and cable cleavage 37.

Retaining means, such as screws 32 and 34, normally extend through the slots 20 and 22 into the surface of the wall 26. The screws 32 and 34 maintain the guard member 14 against the wall 26.

The top portion of the handle 12 is connected through lever arm and cleavage 35 and 37 to pull a cable 36 when the handle 12 is pivoted. The cable may be attached to actuate a mechanism in a railcar, such as mechanism to open doors in case of emergency.

In normal circumstances, the screws 32 and 34 hold the flexible plate 14 against the surface of the wall 26 and the handle 12 within the recess opening 24 of the wall 26. Under emergency conditions, however, a person would grip the manual gripping means 18 and pull it.

Figure 4:
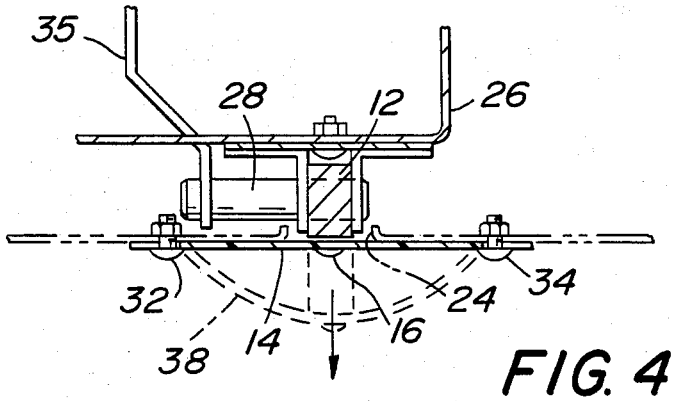
FIG. 4 is a cross-sectional view taken along lines 4—4 of FIG. 1.

When the gripping means 18 is moved, the flexible member 14 starts to flex in a manner illustrated by dotted lines 38 in FIG. 4. Continued movement of the gripper 18 causes the flexible member 14 to move and the slots 20 and 22 to snap past the screws 32 and 34. This action permits further movement of the gripping means 18.

Movement of the gripping means 18 causes the handle 12 to be rotated with the pivot pin 28. Rotation of the handle 12 causes a pulling force to be exerted on the cable 26 resulting in the actuation of a mechanism within the railcar (not shown).

Figure 2:
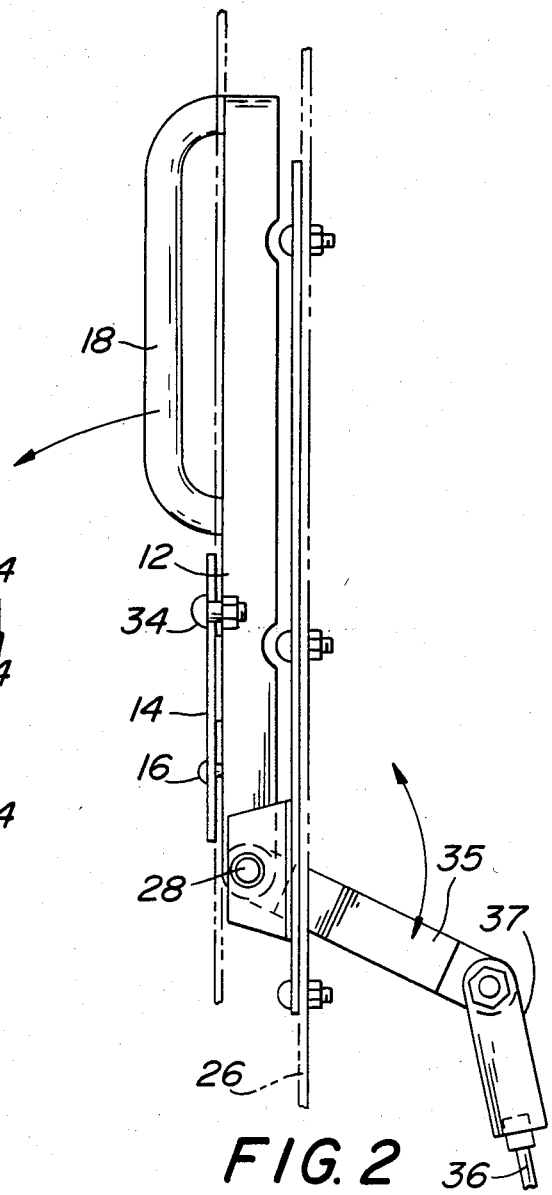
FIG. 2 is a side elevation view of the emergency release handle illustrated in FIG. 1.
Figure 3:
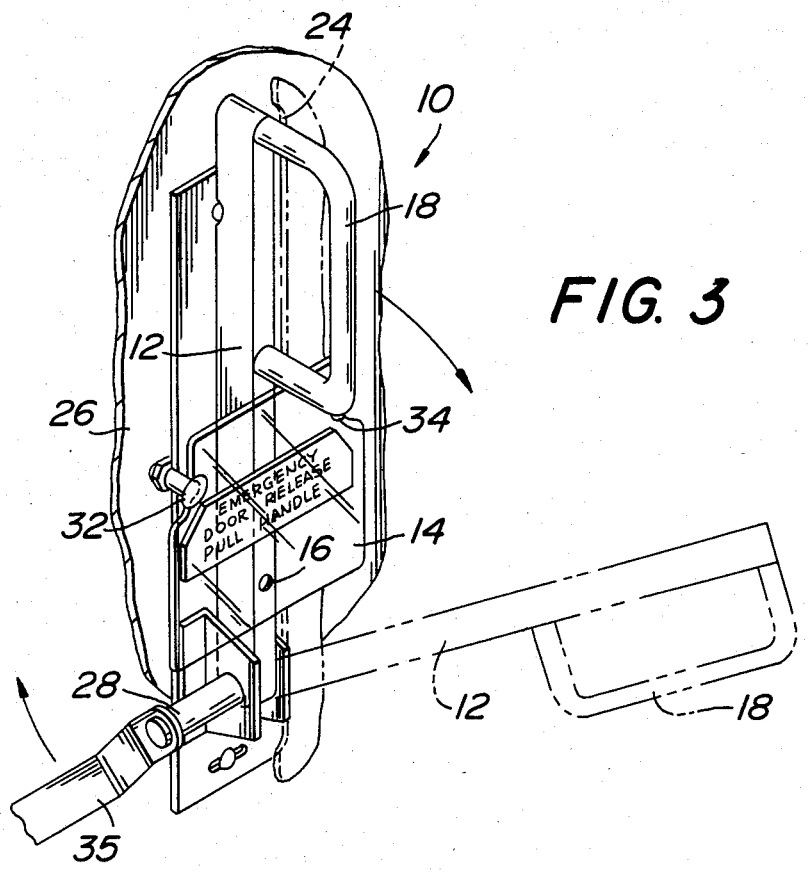
FIG. 3 is an isometric view of the emergency release handle illustrated in FIGS. 1 and 2.

A feature of the present invention involves the limited movement of the handle 12 after the gripping means 18 has been pulled. As illustrated in FIG. 2, after the handle 12 has been operated, the bottom edge of the flexible member 14 contacts the surface of the wall 26. Consequently, the force applied to the cable 26 is limited to the amount necessary to actuate the mechanism involved and not result in excess forces which may tend to damage the cable 26 or any parts with which it is associated.

The flexible member 14 may be transparent and be made of polycarbonate material, for example.

In some situations, the guard plate 14 may not be directly connected to the handle 12 by a screw 16, but be held in place by the slots 20 and 22 and retaining screws 32 and 34.

In addition to minimizing damage to the cable 36 and associated parts, the present invention does not involve the inconvenient and time consuming breaking of glass, which eventually requires replacement. The mechanism 10 described is ready for use immediately after an emergency by merely removing the screws 32 and 34, returning the member 14 to its original position against the surface of the wall 26, and returning the screws to hold the member 14 in place.

The handle arrangement described, while convenient to use, still employs means to inhibit inadvertent use by a passenger. A message on the guard member provides instructions for use of the handle only under emergency conditions.

What is claimed is:

1. In combination with a linkage means element for actuating a mechanism in a railway car under emergency conditions, means for actuating said linkage means under emergency conditions comprising:

(a) a handle pivotally mounted within an interior wall of said rail car and connected to said linkage means;

(b) a flexible member adapted to be connected to said handle and including at least two slots therein;

(c) retaining elements connected to said interior wall through said slots to normally hold said flexible member against said interior wall and said handle within said interior wall; and (d) manual gripping means connected to said handle extending away from said interior wall to permit a person to manually grip and pull to cause said guard member to flex and move past said retaining elements and cause said handle to be pivoted within said interior wall to actuate said linkage means to actuate said mechanism in said railcar.

2. A combination as set forth in claim 1 wherein said linkage means comprises a cable.

3. A combination as set forth in claim 2 wherein said slots are disposed on opposite sides of said flexible member with said sides being disposed vertically when engaging said interior wall.

4. A combination as set forth in claim 3 wherein said flat flexible member is disposed towards the bottom section of said handle, and the bottom edge of said flexible member being disposed to engage said wall to limit the movement of said handle when said handle is pivoted to pull said cable.

5. A combination as set forth in claim 4 wherein said gripping means is disposed on said handle above said flexible member.

6. A combination as set forth in claim 5 wherein said retaining elements comprise removable screws, said screws may be removed to permit said flexible member to be returned to its normal position against said wall after said handle has been operated for an emergency, with said screws then being replaced in said wall to hold said flexible member in place.

* * * * *